United States Patent [19]

Curley et al.

[11] 4,328,802

[45] May 11, 1982

[54] WET DRY SYRINGE PACKAGE

[75] Inventors: Edward M. Curley, Bethesda, Md.; Gerlof Homan, Olivette, Mo.

[73] Assignee: Survival Technology, Inc., Bethesda, Md.

[21] Appl. No.: 149,570

[22] Filed: May 14, 1980

[51] Int. Cl.[3] ..... A61J 1/00

[52] U.S. Cl. ..... 128/272.1

[58] Field of Search ..... 128/272.1, 272.3, 218 M

[56] References Cited

U.S. PATENT DOCUMENTS 3,336,924 8/1967 Sarnoff et al. ..... 128/272.3
3,392,726 7/1968 Pochyla et al. ..... 128/272.1
3,416,657 12/1968 Sorensen, Jr. et al. ..... 128/272.1 X

FOREIGN PATENT DOCUMENTS 2538457 3/1976 Fed. Rep. of Germany ... 128/272.1

*Primary Examiner*—John D. Yasko
*Attorney, Agent, or Firm*—Witherspoon & Hargest

[57] ABSTRACT

A wet-dry syringe package including a syringe adapted to carry a liquid and a vial carrying a dry medicament with cooperating adapters provided on the syringe and vial for telescoping action whereby the syringe needle will be embedded in the vial stopper when the package is in the storage condition. Further movement of the syringe toward the vial causes the needle end to project through the vial stopper and establish fluid communication between the vial and syringe whereby the dry medicament and liquid are mixed. The mixture is then aspirated into the syringe and the syringe is freed of the package elements for ready use.

4 Claims, 2 Drawing Figures

WET DRY SYRINGE PACKAGE

SUMMARY OF THE INVENTION

This invention relates to a syringe and vial combination wherein the syringe contains a liquid and the vial is provided with a dry medicament. The syringe and vial are combined with assorted interengaging elements to form a package wherein the contents of the syringe and vial may be mixed in the vial after which the mixture is aspirated into the syringe for administration of the contents to a patient.

In the prior art, in order to administer a medicant containing a powder or equivalent to a patient, it was necessary to provide a vial filled with powder, separate and distinct from a syringe, and to apply the needle of the syringe to the interior of the vial, then after dissolving the powder aspirate the dissolved powder into the syringe and then apply the needle to a patient. Obviously with such an arrangement the top of the vial penetrated by the needle might not be sterile and the exposed needle would be exposed to non-sterile conditions. Furthermore, the vial and syringe, being separate devices, makes it cumbersome for the physician or nurse to handle the separate parts particularly under stressed conditions that may exist at the bedside of a patient.

In another form, in the prior art, the powder or equivalent and the liquid solvent are housed in two different compartments in the syringe making it necessary for the syringe to be fairly large so that it may house both materials and making the syringe cumbersome in use.

In yet another form, in the prior art, the vial with the powdered medicament therein is operatively connected to a syringe having a liquid therein to form a unit. Operative cooperation of the syringe and vial causes the liquid to be introduced into the vial for mixing with the powdered medicament after which the mixture is aspirated into the syringe which is then dissociated from the vial and is ready for use. This type of unit is disclosed in U.S. Pat. No. 3,336,924 to J. J. Sarnoff and J. W. Balenger.

It is an object of this invention to improve on the wet-dry combination generally described in U.S. Pat. No. 3,336,924.

It is a further object to provide a wet-dry syringe package having a minimum number of elements so as to provide an economical and easy to use combination.

It is a still further object to provide a wet-dry syringe package wherein the vial and syringe are cooperatively assembled whereby the bared end of the needle is slightly embedded in the stopper which closes off the vial so that it is not necessary that a diaphragm or other closure be provided in the syringe to prevent flow of the syringe liquid out through the needle.

The above and additional objects will become more apparent when taken in conjunction with the following drawing and detailed description.

IN THE DRAWING

FIG. 1 is a cross sectional view of the wet-dry syringe package in the prearmed storage condition with the end of the syringe needle embedded in the vial stopper, and FIG. 2 is a cross sectional view similar to that of FIG. 1 illustrating the syringe package in the armed condition with the end of the syringe needle in communication with the interior of the vial.

DETAILED DESCRIPTION

Figure 1:
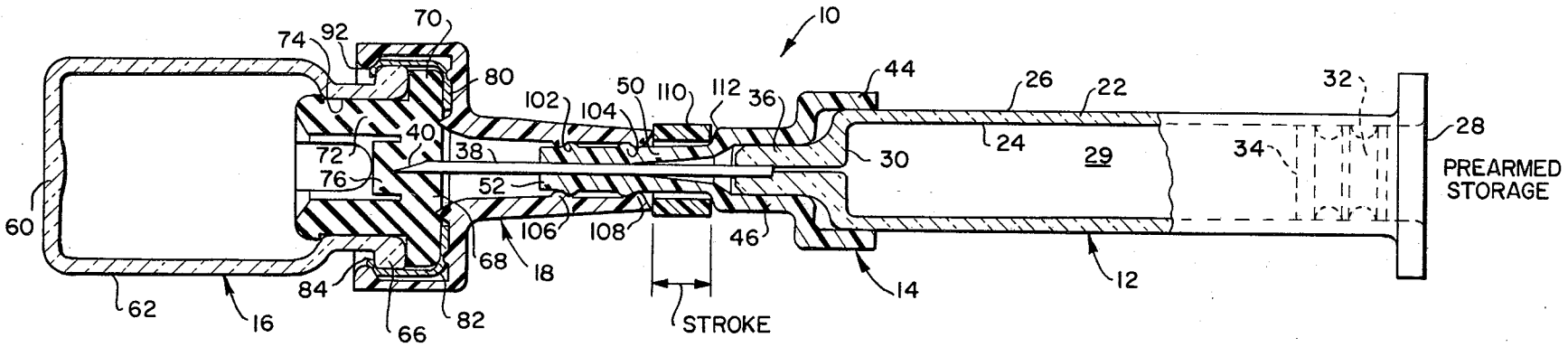

As shown in the two figures of the drawing the wet-dry syringe package 10 comprises four main components namely a syringe 12 mounting a syringe adapter 14 on its needle end and a vial 16 carrying a vial stopper 18 on its stoppered end. More particularly the syringe 12 comprises a cylindrical barrel 22 having an inner cylindrical surface 24 and an outer cylindrical surface 26. The cylindrical barrel 22 has a rearward end 28 which is open and a forward end 30 which is generally closed. A piston 32 is slidably carried within the barrel 22 and when positioned adjacent the rearward end 28 thereof forms a liquid or medicament chamber 29 between the closed forward end 30 and the forward end 34 of piston 32. The forward end 30 of the barrel 22 is closed off by a needle hub 36 which is reduced down from the barrel 22 and projects forwardly with a slight taper which provides a smaller diametered hub section as it goes forward. A hollow needle 38 is mounted in the hub 36 to provide fluid communication between the liquid chamber 29 and the end 40 of the needle 38.

The syringe adapter 14 comprises a cylindrical major body 44 sized to snugly engage the outer surface 26 of barrel 22 and has a minor body 46 of reduced diameter coaxial with the major body 44 and extending outwardly therefrom in snug engagement with the needle hub 36. A generally cylindrical needle guide 50 having an outer diameter somewhat less than the minor body 46 extends forwardly therefrom in a coaxial manner. The forward inner portion 52 of the needle guide 50 is sized to grip the needle 38 which it surrounds and guides.

The vial 16 comprises a cylindrical glass container having a bottom 60 with a side wall 62 forming an open end which has a necked down portion 64 with an annular flange 66 extending outwardly therefrom. The vial opening is closed by a rubber stopper 68 having a circular base 70 generally conforming in diameter to that of annular flange 66 with a cylindrical portion 72 extending therefrom and being sized to snugly engage the inner face 74 of the necked down portion 64. A plug 76 extends from the base 70 into the inside of the vial. This plug portion 76 is provided to make certain that the end 40 of the needle 38 does not project into the inside of the vial when the package 10 is in the prearmed storage condition. The stopper 68 is retained in place by means of metal retaining cap 80 which fits over the top of the stopper 68 has a flange 82 extending dorwardly over the outer edge of the stopper base 70 and the flange 66 and is spun over same to produce a retaining lip 84 as shown.

Vial adapter 18 comprises a circular base 90 sized to snugly fit over the retaining cap 80. The base 90 is provided with inwardly directed retaining projections 92 which firmly grip the retaining cap lip 84 to affix the vial adapter 18 to the vial 16. A tubular projection 94 extends from adapter base 90 in a coaxial manner with a diameter less than that of the base. Actually, the tubular projection 94 tapers slightly, becoming smaller in diameter as it extends outwardly from the base 90.

Figure 2:
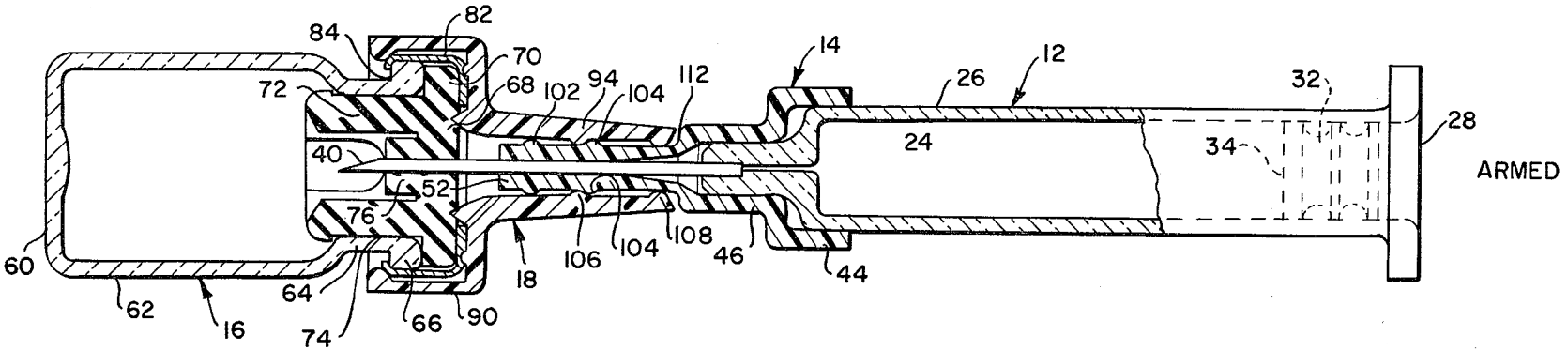

As illustrated in both FIGS. of the drawing, the vial adapter tubular projection 94 is sized to fit over needle guide 50 in telescoping manner. In order to retain the vial 16 and the syringe 12 in proper related positions, the two telescoping portions are provided with cooperating and interengaging means to furnish the requisite positioning. More specifically, the outer surface of the needle guide 50 is provided with annular beads 102 and 104 spaced from each other as shown. Similarly, the inner face of the vial adapter tubular projection 92 is provided with two annular beads 106 and 108 spaced from each other as shown. These annular beads serve to retain the vial and syringe in the prearmed storage position and the armed position as shown in FIGS. 1 and 2 respectively. As shown in FIG. 1, in order to make certain that the unit is not armed accidentally or prematurely a locking collar 110 is fitted over the needle guide 50 in the space between the shoulder 112 on the needle guide 50 and the end of the vial adapter projection 94. The locking collar 110 is generally made of a resilient material and is provided with a transverse cut so that the collar may be spaced apart and slipped over the needle guard 50.

In use, the wet-dry syringe package 10 is assembled as shown in FIG. 1 with a dry medicament in the vial 16 and a liquid in the syringe 12. The locking collar 110 is placed around the needle guide 50 to make certain that the needle guide 50 cannot be further telescoped into the vial adapter projection 94. It should be noted that in this condition, the needle end 40 is embedded in the stopper 68 to prevent flow of liquid from the syringe. Thus the entire needle at this point is maintained in a sterile condition. When it is desired to activate or arm the unit, the locking collar 110 is removed and the syringe 12 is pushed toward the vial 16 thereby causing the needle guide 50 to telescope further into the vial adapter projection 94 until the shoulder 112 on the needle guide 50 engages the end of vial adapter projection 94. Also note that annular bead 106 on vial adapter projection 94 engages annular bead 104 on the needle guide 50 as shown in FIG. 2. The relative movement causes the needle end 40 to project into the vial 16 thereby establishing fluid communication between the vial and the syringe. Next the piston 32 is pushed toward the needle end of the syringe barrel 22 to force the liquid into the vial where mixing with the powdered medicament takes place. After mixing, the mixture is aspirated into the syringe which is then freed of the needle guide 50 so that it is then ready for use. It should be noted that sterile integrity is maintained until the syringe is freed of the other elements and is ready for use.

By now it should be abundantly clear that the wet-dry syringe package of this invention is the ultimate in simplicity, ease of use and economy of parts. The piston 32 is of the conventional type which is provided with means in its rearward portion to receive a piston rod for conventional purposes. Such is illustrated and described in previously described U.S. Pat. No. 3,336,924.

What is claimed is:

1. A wet-dry syringe assembly adapted for storage in a prearmed condition ready for instant arming, said assembly consisting of:

(1) a syringe having a cylindrical barrel open at its rearward end and closed at its forward end, a piston slidably carried within the barrel adjacent the rearward end to close that end off and form a liquid chamber between the forward end of the piston and the closed end of the cylindrical barrel, a needle positioned in the forward closed end of the cylindrical barrel with its inner end in direct communication with the liquid chamber to establish fluid communication between the liquid chamber and the forward exposed end of the needle, (2) a syringe adapter fitting over the forward end of the syringe, said syringe adapter comprising an enlarged head portion snugly engaging and fitting on the forward end of the syringe barrel, a tubular needle guide portion of reduced diameter extending forwardly from the head portion, the length of said tubular portion being less than the needle it surrounds, (3) a medicament vial adapted to carry the dry medicament and to receive the liquid stored in the syringe, said vial having a closed bottom and open top portion, a stopper for closing the open top portion, a retaining member for holding the stopper in the vial, (4) a vial adapter fitting on the top portion of the vial said vial adapter comprising a base portion affixed to the stoppered end of the vial, a tubular guide projecting outwardly from the base, said guide having an inner diameter sized to fit over a portion of the needle guide of the syringe to provide for telescopic action therebetween, (5) cooperating means on the inner surface of the tubular guide on the vial adapter and the outer surface of the needle guide of the syringe adapter to maintain the syringe and the vial in spaced prearmed storage position wherein the forward end of the syringe needle is embedded in the vial stopper, to thereby insure complete sterility between needle, liquid chamber and vial and to maintain the syringe and the vial in armed position with the end of the needle projecting through the stopper into the vial to establish fluid communication between the syringe medicament chamber and the vial.

2. The invention as set forth in claim 1 and wherein the cooperating means on the inner surface of the tubular guide of the vial adapter and the outer surface of the needle guide comprise a pair of annular beads spaced apart on the tubular guide and a similar pair of spaced annular beads on the needle guide positioned to frictionally engage each other.

3. The invention as set forth in claim 2 and wherein retaining means are provided for maintaining the assembly in prearmed storage position.

4. The invention as set forth in claim 3 and wherein the retaining means comprising a resilient ring having a cut out portion to allow it to be positioned around the needle guide to hold it longitudinally spaced from the tubular guide of the vial.

* * * * *